US011094302B2

(12) United States Patent
Abe

(10) Patent No.: US 11,094,302 B2
(45) Date of Patent: Aug. 17, 2021

(54) EFFECT IMPARTER FOR MUSICAL INSTRUMENT

(71) Applicant: Yamaha Corporation, Shizuoka (JP)

(72) Inventor: Banri Abe, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/846,007

(22) Filed: Apr. 10, 2020

(65) Prior Publication Data

US 2020/0342838 A1 Oct. 29, 2020

(30) Foreign Application Priority Data

Apr. 23, 2019 (JP) ..... JP2019-082086

(51) Int. Cl.
*G10D 13/18* (2020.01)

(52) U.S. Cl.
CPC ..... *G10D 13/18* (2020.02)

(58) Field of Classification Search
CPC ..... G10D 13/18
See application file for complete search history.

(56) References Cited

U.S. PATENT DOCUMENTS 2,085,819 A * 7/1937 Meyer ..... G10D 13/18 84/415
2,166,733 A * 7/1939 Slingerland ..... G10D 13/18 84/415
2,517,124 A * 8/1950 Ludwig ..... G10D 13/02 84/415
3,113,481 A * 12/1963 Thompson ..... G10D 13/18 84/415
5,204,484 A * 4/1993 Netto ..... G10D 13/18 84/415
5,844,157 A * 12/1998 Kasha ..... G10D 13/18 84/415
7,202,405 B2 * 4/2007 Takegawa ..... G10D 13/02 84/415
7,435,887 B2 * 10/2008 Nickel ..... G10D 13/18 84/415
7,728,211 B1 * 6/2010 Gatzen ..... G10D 13/02 84/415
7,884,272 B2 * 2/2011 Abe ..... G10D 13/02 84/415
8,426,711 B2 * 4/2013 Abe ..... G10D 13/02 84/415
9,704,460 B2 * 7/2017 Hacker ..... G10D 13/02
10,043,498 B2 * 8/2018 Sato ..... G10D 13/18
10,861,425 B1 * 12/2020 D'Addario et al. ... G10D 13/02
2016/0042725 A1 * 2/2016 Huang ..... G10D 13/18 84/415
2018/0204550 A1 7/2018 Steinhauser
2020/0342838 A1 * 10/2020 Abe ..... G10D 13/18

* cited by examiner

*Primary Examiner* — Robert W Horn
(74) *Attorney, Agent, or Firm* — Global IP Counselors, LLP

(57) ABSTRACT

An effect imparter for a musical instrument includes a wire bundle including at least one snare, and a plate that has a hook configured to be hooked by a string and that is fixed to a first end portion of the wire bundle.

10 Claims, 7 Drawing Sheets

EFFECT IMPARTER FOR MUSICAL INSTRUMENT

CROSS-REFERENCE TO RELATED APPLICATIONS

This application claims priority to Japanese Patent Application No. 2019-082086, filed on Apr. 23, 2019. The entire disclosure of Japanese Patent Application No. 2019-082086 is hereby incorporated herein by reference.

BACKGROUND

Technical Field

The present invention relates to an effect imparter for a musical instrument that is used for a musical instrument such as a snare drum.

Background Information

Effect imparters used for musical instruments are known from the prior art. For example, in a snare drum, an effect imparter (snappy), which includes the snares, is selectively brought into contact with and separated from the drum head, whereby the vibrations of the drum head are transmitted to the effect imparter, and a special acoustic effect can be obtained. The effect imparter is generally composed of a wire bundle formed by arranging, in parallel, a plurality of snares made of wire material, and a pair of plates that hold the two ends of the wire bundle. The pair of plates are respectively connected to a pair of strainers provided on the shell of the drum by means of a connecting member. A belt-shaped member that is used as the connecting member is known from the prior art (U.S. Pat. No. 7,728,211). However, as disclosed in U.S. Patent Application No. 2018/204550, the mainstream choice is to employ a string member as the connecting member.

SUMMARY

Conventionally, there is demand for an effect imparter that can be easily attached/detached or replaced with respect to a drum main body. In U.S. Patent Application No. 2018/204550, the user can detach an effect imparter from a strainer while keeping a string member attached to the effect imparter. However, it is necessary to adjust the tension each time the effect imparter is replaced, which is troublesome. For example, when one effect imparter is replaced with another, it becomes necessary to readjust the tension. It should be noted that in order to reproduce the same tension, it is conceivable to preliminarily place the string members in the same state before and after replacement of the effect imparters; however, such work is complicated and impractical.

One object of this disclosure is to provide an effect imparter for a musical instrument that can facilitate replacement work.

According to one embodiment of this disclosure, an effect imparter for a musical instrument comprises a wire bundle including at least one snare, and a plate that has a hook configured to be hooked by a string and that is fixed to a first end portion of the wire bundle.

According to one embodiment of this disclosure, it is possible to facilitate the replacement work.

DETAILED DESCRIPTION OF THE EMBODIMENTS

Selected embodiments will now be explained with reference to the drawings. It will be apparent to those skilled in the field from this disclosure that the following descriptions of the embodiments are provided for illustration only and not for the purpose of limiting the invention as defined by the appended claims and their equivalents.

Figure 1:
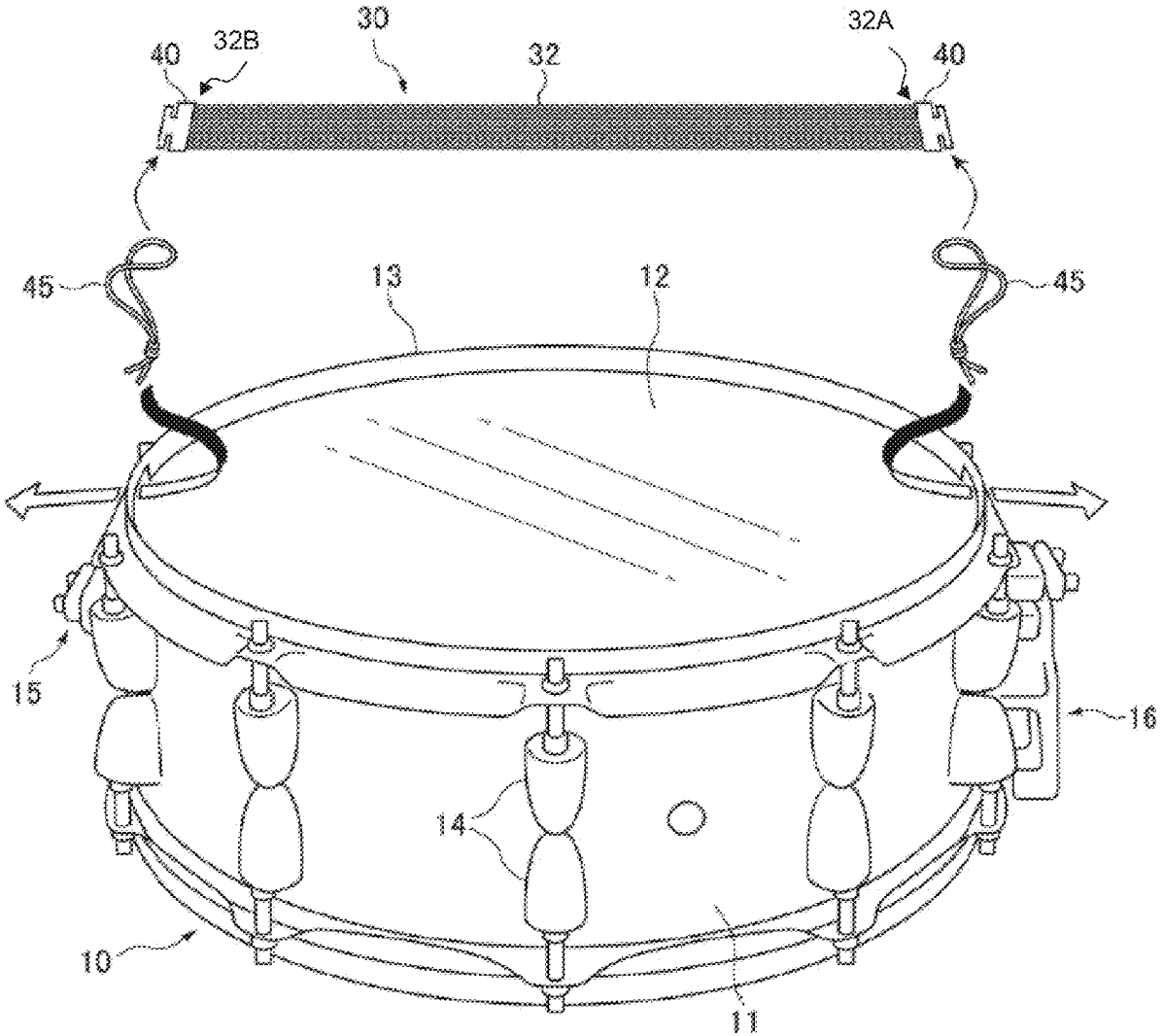
FIG. 1 is a perspective view of an effect imparter for a musical instrument and the musical instrument to which the effect imparter is applied.

FIG. 1 is a perspective view of an effect imparter (effect imparting tool) for a musical instrument and the musical instrument to which the effect imparter is applied, according to one embodiment of this disclosure. This musical instrument is a percussion instrument, for example, and a snare drum 10 is shown in FIG. 1 as an example of the percussion instrument. The effect imparter is a snare wire 30, so-called a snappy.

The snare drum 10 has a shell 11. A batter head is disposed on one (front side) opening of the cylindrically shaped shell 11, and a resonance head 12 is disposed on the other (back side) opening. A plurality of lugs 14 are fixed on the outer circumferential surface of the shell 11 at equal intervals. An annular hoop 13 is disposed in the opening of the shell 11 on the side on which the resonance head 12 is disposed. The snare wire 30 is usually provided on the outer surface of the resonance head 12. A pair of mounting units 15, 16 are arranged on the outer circumferential surface of the shell 11 at symmetrical positions along the diametral direction of the shell 11. These mounting units 15, 16 form a pair of so-called strainers. The mounting unit 15 on the fixed side and the mounting unit 16 on the movable side are arranged in positions that avoid the lugs 14. String members (string, additional string) 45 are attached to both ends of the snare wire 30. One of the string members 45 is connected to the fixed-side mounting unit 15, and the other string member 45 is connected to the movable-side mounting unit 16.

Figure 2:
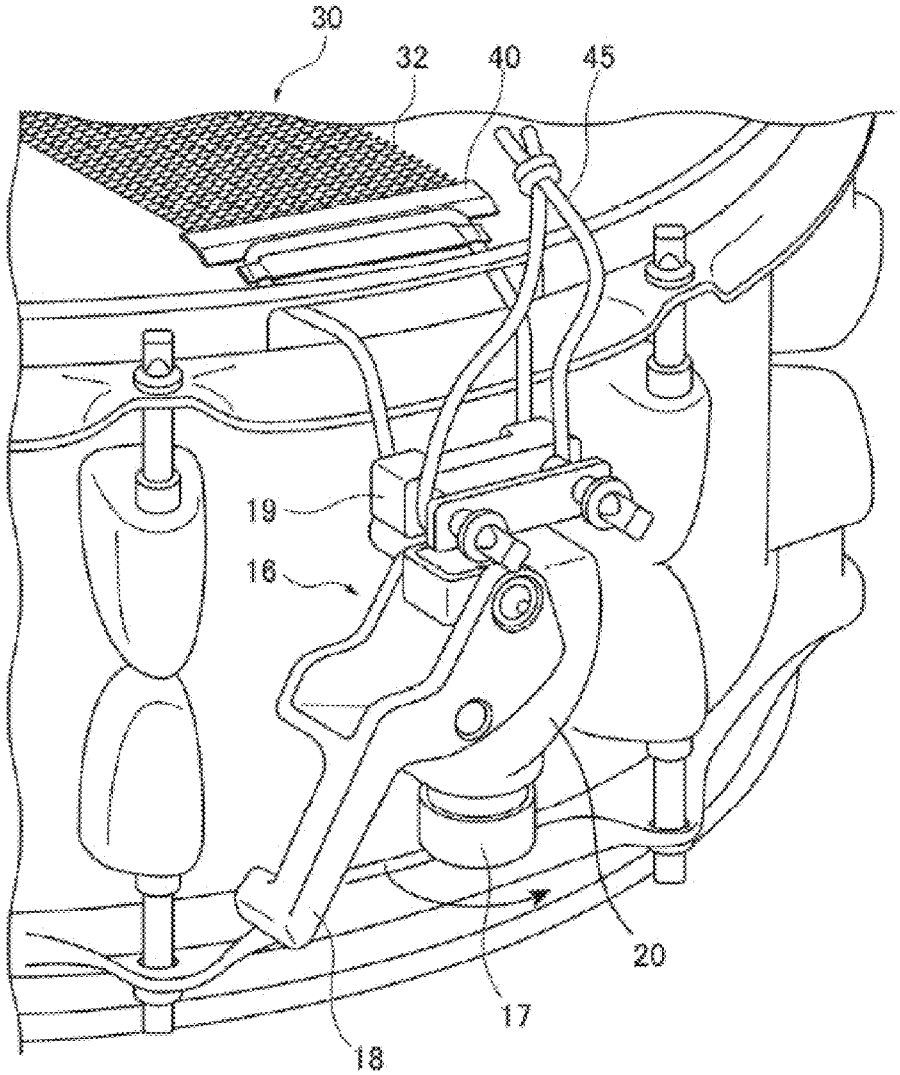
FIG. 2 is an enlarged perspective view of the vicinity of a mounting unit on the movable side.

FIG. 2 is an enlarged perspective view of the vicinity of the mounting unit 16 on the movable side. The mounting unit 16 includes a fixed base 20, a movable base 19, a tension adjusting screw 17, a lever 18, and the like. The movable base 19 is provided so as to be movable with respect to the fixed base 20 in the center axis direction of the shell 11. The string member 45 on the movable side is connected to the movable base 19. When the tension adjusting screw 17 is operated, the movable base 19 moves relative to the fixed base 20, thereby adjusting the tension of the snare wire 30. In addition, when the lever 18 is operated, the movable base 19 moves relative to the fixed base 20, so that the snare wire 30 can be switched between a state of contact with the resonance head 12 and a state of no contact with the resonance head 12. In the case that a percussion performance is carried out with the snare wire 30 in a state of contact with the resonance head 12, a special sound effect is added. On the other hand, when the snare wire 30 is replaced or remounted, the user operates the lever 18 and places the snare wire 30 in the state of no contact with the resonance head 12.

When the snare wire 30 is replaced, it is possible to remove each string member 45 from the mounting units 15, 16, reattach each string member 45 to another snare wire 30, and connect each string member 45 to the mounting units 15, 16. However, such work is inefficient. Therefore, in this embodiment, the snare wire 30 is configured to be easily attached to/detached from each string member 45, so that the snare wire 30 can be easily replaced even while each string member 45 is connected to the mounting units 15, 16. The detailed configuration of the snare wire 30 will be described below.

Figure 3:
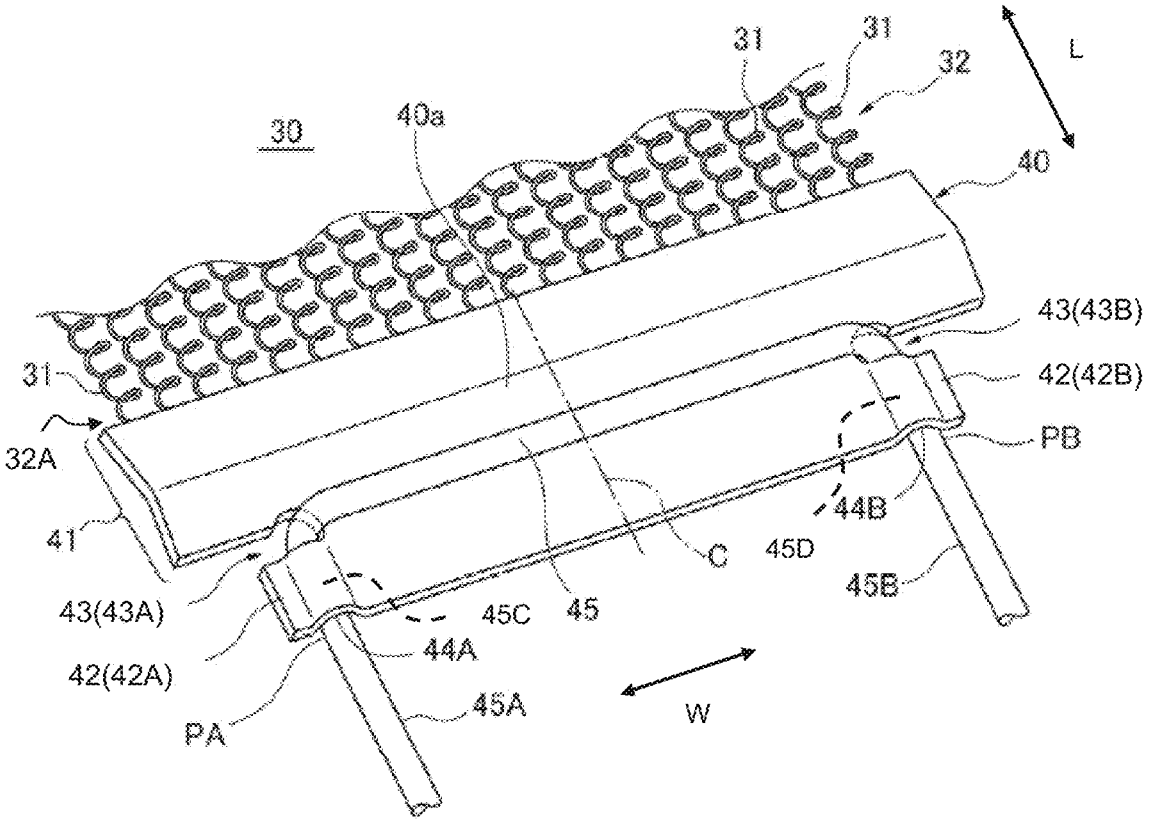
FIG. 3 is a perspective view of one end portion of a snare wire.

FIG. 3 is a perspective view of one end portion of the snare wire 30. The snare wire 30 includes a wire bundle 32 including at least one snare 31, and a plate 40 that has a hook 42 (42A, 42B) configured to be hooked by the string member 45 and that is fixed to a first end portion 32A of the wire bundle 32. First, the snare wire 30 comprises the wire bundle 32 and two plates 40 (plate, additional plate), as shown in FIG. 1. The wire bundle 32 is composed of a plurality of snares 31 (refer to FIG. 3). Specifically, a plurality of thin snares 31 are arranged in parallel at prescribed intervals in a direction orthogonal to a longitudinal direction L. The pair of the plates 40 are fixed to the end portions (first end portion 32A and second end portion 32B of the wire bundle 32) of the snares 31 by means of soldering, or the like. FIG. 3 shows only one of the pair of plates 40. The plate 40 is formed integrally with a metal, or the like. It should be noted that the wire bundle 32 can be made up of one or more snares 31. In addition, the number of parallel snares 31 in the wire bundle 32 can be greater than the number of snares 31 actually being used by folding at least one snare 31 over the plate 40.

In this embodiment, the pair of plates 40 have the same configuration. As explained below, each of the plates 40 (plate, additional plate) has a hook 42 (hook, additional hook). Accordingly, the configuration of the plates 40 will be described by focusing on one of the plates 40. More specifically, the plate 40 has a main portion 41 and a T-shaped portion that is connected to the main portion 41. The plate 40 has, as the hook 42, a pair of hooks 42A, 42B in the main portion 41, on the side opposite to a holding portion for holding the wire bundle 32, in the longitudinal direction L of the wire bundle 32. The hooks 42A, 42B include a pair of cutout portions 43 (43A, 43B). By forming the pair of cutout portions 43A, 43B, the hooks 42A, 42B are formed so as to each have a projection. The cutout portions 43A, 43B are adjacent to the respective projections formed by the hooks 42A, 42B on the wire bundle 32 side. The cutout portions 43A, 43B open in opposite directions (outer side in a width direction W of the wire bundle 32) from each other in the width direction W of the wire bundle 32. The hooks 42A, 42B are locking portions for hooking the string member 45. The cutout portions 43A, 43B are openings into which the string member 45 are fitted.

Figure 4:
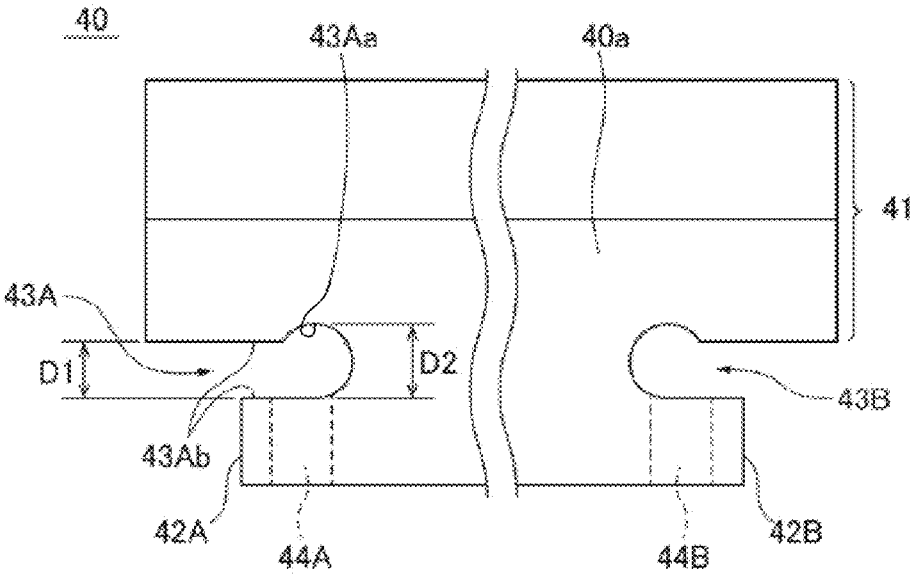
FIG. 4 is a plan view of one plate.
Figure 5:
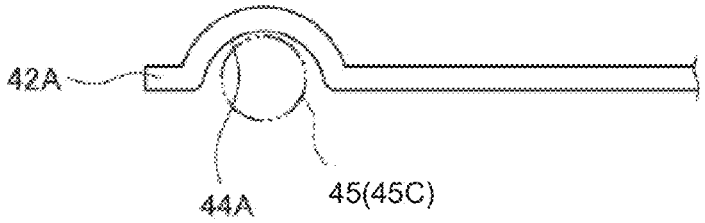
FIG. 5 is a front view of one hook.

FIG. 4 is a plan view of one plate 40. FIG. 5 is a front view of one hook 42A. The hooks 42A, 42B are essentially line symmetrical ("essentially line symmetrical" is intended to include line symmetrical, i.e. perfect line symmetry, and the same applies below) with respect to the center axis (center axis C shown in FIG. 3) of the wire bundle 32 in the width direction W. As illustrated in FIGS. 4 and 5, a concave portion (concave) 44A is formed in the hook 42A. The concave portion 44A faces the resonance head 12 when the snare wire 30 is attached to the snare drum 10. The concave portion 44A has a semicircular cross section that is recessed toward the side away from the resonance head 12. A concave portion (concave) 44B is similarly formed in the hook 42B.

A state in which the string member 45 is appropriately hooked on the hooks 42A, 42B as illustrated in FIG. 3 is referred to as the state of attachment of the string member 45 to the plate 40. In this attachment state, extension portions 45A, 45B (two extension portions) extend in the longitudinal direction L of the wire bundle 32, from the hooks 42A, 42B of the plate 40, respectively, toward the direction opposite to the wire bundle 32. The positions of the string 45, from which the extension portions 45A, 45B extend from the hooks 42A, 42B, are referred to as extension positions PA, PB (two positions), respectively. The two extension positions PA, PB are essentially line symmetrical with respect to the center axis (line) C of the wire bundle 32 in the width direction W. In the attached state of the string member 45, the string member 45 is exposed on surface 40*a* of the plate 40 between the cutout portions 43A, 43B on the side opposite the resonance head 12. In addition, the string member 45 penetrates the cutout portions 43A, 43B and passes through the concave portions 44A, 44B, and reaches the extension positions PA, PB. From there, the string member 45 extends from the extension positions PA, PB as the extension portions 45A, 45B.

There are cases in which a performance is conducted in a state in which the snare wire 30 is separated from the resonance head 12. In such cases, the snare wire 30 extends loosely and the string member 45 is also relaxed, so that there is the risk that the string member 45 will unintentionally fall off the hooks 42A, 42B due to vibrations or an external force. Therefore, in this embodiment, a means is devised so that the string member 45 does not easily become detached from the hooks 42A, 42B when the snare wire 30 extends loosely.

First, as illustrated in FIG. 4, the cutout portion 43A has a wide portion (second portion) 43Aa and a narrow portion (first portion) 43Ab and is essentially U-shaped in a plan view. The narrow portion 43Ab is the part of the cutout portion 43A that is open to the outside. A part of the narrow portion 43Ab serves as an entry to the cutout portion 43A from the outside. In the longitudinal direction L of the wire bundle 32, the width of the wide portion 43Aa is D2 (second width), the width of the narrow portion 43Ab is D1 (first width), and the relationship is D2>D1. That is, the width of the entry of the cutout portion 43A is narrower. Due to this relationship, the narrow portion 43Ab functions as a retain portion (string retainer) that retains the string member 45 in the cutout portion 43A and makes it difficult for the string member 45, which is fitted in the wide portion 43Aa, to come off the cutout portion 43A.

The shape of the cutout portion 43A has the form of about an letter R, but the shape is not limited to the R shape as long as the width of the wide portion 43Aa is wider than that of the narrow portion 43Ab. In the cutout portion 43A, the R shape is formed on the side of the wire bundle 32 in the longitudinal direction L of the wire bundle 32. However, the wide portion 43Aa of the R shape can be formed on the side opposite the wire bundle 32, or on both sides in the longitudinal direction L of the wire bundle 32. Thus, the wide portion 43Aa can be wider than the narrow portion 43Ab on both sides of the wide portion 43Aa, rather than just one side. Also, each cutout portion 43 can be formed such that a width in the longitudinal direction L becomes minimal in the vicinity of the end position on the opening side of each cutout portion 43. As long as there is a portion where the width in the longitudinal direction L of the wire bundle 32 becomes less in the vicinity of the end position on the opening side of the cutout portion 43A than that of a portion of the inner side of each cutout portion 43, the function of preventing the string member 45 from falling off can be achieved. Therefore, the shape of the cutout portion 43A is not limited to the illustrated shape.

Next, the concave portion 44A accommodates a portion 45C of the string member 45 in the vicinity of the extension position PA. Accordingly, the concave portion 44A functions as a restriction portion (string holder) that partially holds the string member 45 and restricts the string member 45 from becoming displaced in the width direction W of the wire bundle 32 at the extension position PA. When the string member 45 is loosened, the plate 40 and the string member 45 can receive a force relative to the width direction W of the wire bundle 32. In such a case, there is the risk that the string member 45 will separate from and come off the cutout portion 43A. However, since the portion of the string member 45 accommodated in the concave portion 44A is not easily displaced in the width direction W of the wire bundle 32, a state of engagement of the string member 45 and the cutout portion 43A is easily maintained. From the standpoint of fulfilling the function of a restriction portion (string holder), the cross-sectional shape of the concave portion 44A is not limited to a semicircular shape, but can take on the form of a pair of tapered surfaces or that of a half-polygon. The configuration of the cutout portion 43B is the same as that of the cutout portion 43A, except for being essentially line symmetrical with the cutout portion 43A with respect to the center axis (line) C in the width direction W of the wire bundle 32. The concave portion 44B similarly accommodates a portion 45D of the string member 45 in the vicinity of the extension position PB and function as the restriction portion (string holder).

The pair of hooks 42 or the pair of cutout portions 43 can be formed by notching or stamping a plate-like member made of metal, or the like. In addition, the concave portions 44A, 44B can be formed by bending, for example.

In such a configuration, when replacing the snare wire 30, the user operates the lever 18 and places the snare wire 30 in the state of no contact with the resonance head 12 and removes the string members 45 from the plates 40. When removing each string member 45, the user operates to spread the interval between the extension portions 45A, 45B of each string member 45 and removes each of the string members 45 from the hooks 42A, 42B. When each of the string members 45 is removed, the string members 45 normally remain connected to the mounting units 15, 16, so are essentially in a loop shape. The user then attaches each of the string members 45 to plates 40 of another snare wire 30. When attaching each of the string members 45, the user runs each string member 45 along the width direction W of the wire bundle 32 on the surface 40*a* of each of the plates 40, and hooks the string member 45 to each of the hooks 42A, 42B. Then, the string member 45 is accommodated in the concave portions 44A, 44B. Since it is not necessary to pass the string member through a hole formed on the plate, as in the prior art, attachment/detachment is easy even if the string member 45 has a loop shape.

According to the present embodiment, the plates 40 fixed to both ends of the wire bundle 32 both include the hooks 42A, 42B for hooking the string member 45. The user can replace the snare wire 30 by simply attaching/detaching the string member 45 to/from the plate 40. In addition, it is less likely that it will be necessary to adjust the tension when replacing another snare wire 30 of the same length. Additionally, even when the snare wire 30 is temporarily removed and the same snare wire 30 is reattached, the necessity to adjust the tension hardly occurs as long as a state relating to the length of the string member 45 does not change. Therefore, it is possible to facilitate the work of replacing the snare wire 30.

In addition, the hooks 42A, 42B are essentially line-symmetrical with respect to the center axis (line) C in the width direction W of the wire bundle 32. In a state in which the string member 45 is hooked onto the hooks 42A, 42B, the extension positions PA, PB are at essentially line-symmetrical positions with respect to the center axis (line) C of the wire bundle 32 in the width direction W. Accordingly, it is possible to maintain the important parallel orientation of the snare wire 30 during use. That is, it is possible to cause the wire bundle 32 to abut the resonance head 12 in a parallel manner.

In addition, regarding the width of each cutout portion 43 in the longitudinal direction L of the wire bundle 32, the width D1 of the narrow portion 43Ab is narrower than the width D2 of the wide portion 43Aa. In other words, there is a portion where the width in the longitudinal direction L of the wire bundle 32 becomes less in the vicinity of the end position on the opening side of each cutout portion 43 than that of a portion of the inner side of each cutout portion 43. Accordingly, it is possible to prevent the string member 45 from becoming unintentionally detached from the hooks 42A, 42B, particularly in a state in which the snare wire 30 is loosened and not in contact with the resonance head 12. In addition, each of the concave portions 44A, 44B accommodates the portion of the string member 45 in the vicinity of the extension positions PA, PB and restricts the string member 45 from becoming displaced in the width direction W of the wire bundle 32. Accordingly, the state in which the string member 45 is accommodated in the concave portions 44A, 44B can be easily maintained, and the state of engagement of the string member 45 and the cutout portions 43A, 43B can be easily maintained. As a result of these configurations, it is possible to suppress the unintentional falling off the snare wire 30 from the string member 45.

Figure 6:
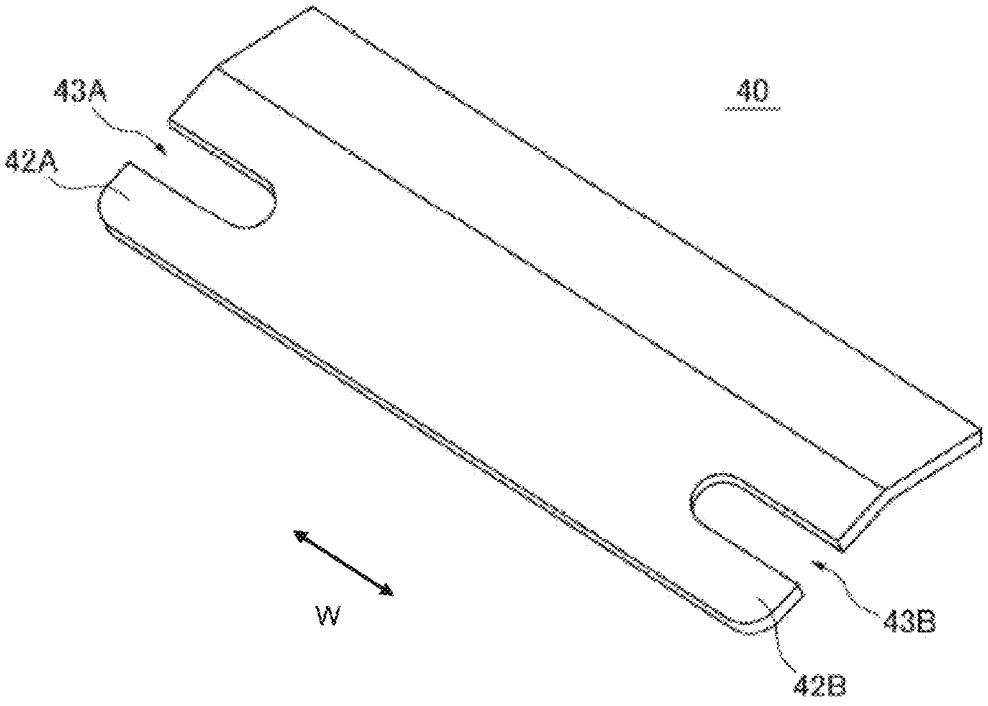
FIG. 6 is a perspective view of a plate of a modified example.

Modified examples will be described next, with respect to FIGS. 6 to 11. The descriptions of the parts of the Modified examples that are substantially identical to the parts of the embodiment explained above may be omitted for the sake of brevity. However, it will be apparent to those skilled in the art from this disclosure that the descriptions and illustrations of the embodiment explained above also apply to the modified examples, except as discussed and/or illustrated herein. FIGS. 6 to 9 are perspective views of the plate 40 according to a modified example. First, in the examples shown in FIGS. 1 to 5, the interval between the distal ends of the hooks 42A, 42B is narrower than the width of the plate 40 in a direction (width direction W) orthogonal to the longitudinal direction L of the wire bundle 32. However, as shown in FIG. 6, the distal ends of the hooks 42A, 42B can be the same as the width of the plate 40 in the direction (width direction W) orthogonal to the longitudinal direction L of the wire bundle 32. In addition, in the example shown in FIG. 6, since the concave portions 44A, 44B, the wide portion 43Aa, and the narrow portion 43Ab are not provided, production is easy. Providing the concave portions 44A, 44B is also not essential in the examples shown in FIGS. 1 to 5. The width of each cutout portion 43 can be made the same without providing the wide portion 43Aa and the narrow portion 43Ab in the examples shown in FIGS. 1 to 5 as well. From the standpoint of fulfilling the function of preventing the string member 45 from falling off, the configuration can be such that either the concave portions 44A, 44B or the wide portion 43Aa and the narrow portion 43Ab are provided.

Figure 7:
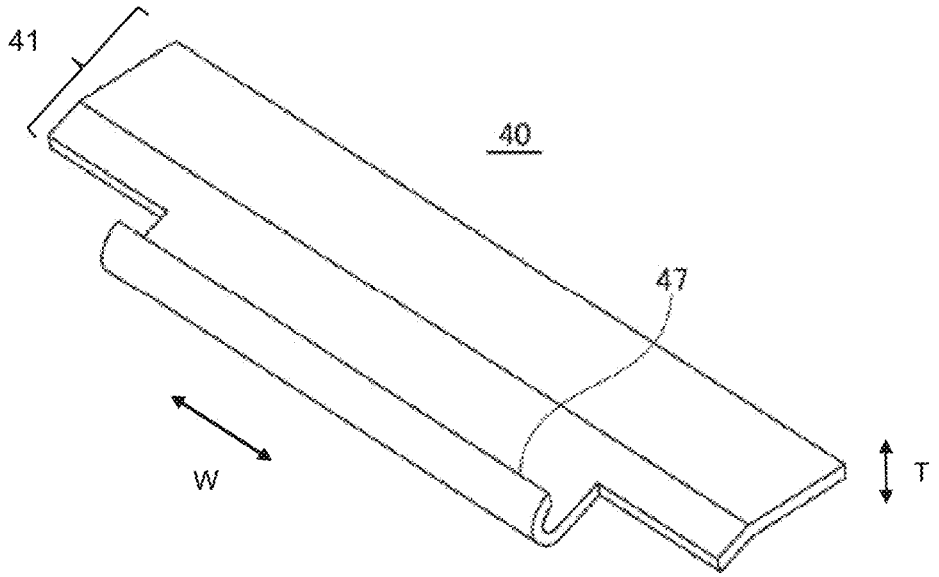
FIG. 7 is a perspective view of a plate of a modified example.

In the example shown in FIG. 7, one hook-shaped claw 47 (claw, claw portion) is provided as a different hook, instead of providing the hooks 42A, 42B. The claw 47 extends from the main portion 41 of the plate 40, in particular, from an end of the main portion 41 of the plate 40 toward a thickness direction T of the plate 40, and then is bent toward the wire bundle 32 side. The claw 47 is essentially line symmetrical about the center axis (line) C in the width direction W of the wire bundle 32. In a state in which the string member 45 is hooked onto the claw 47, the extension positions PA, PB of the string member 45 in the width direction W are at essentially line-symmetrical positions with respect to the center axis (line) C in the width direction W of the wire bundle 32. The claw 47 can be formed by bending the end of the plate 40, for example, and thus production is easy and the configuration is simple.

Figure 8:
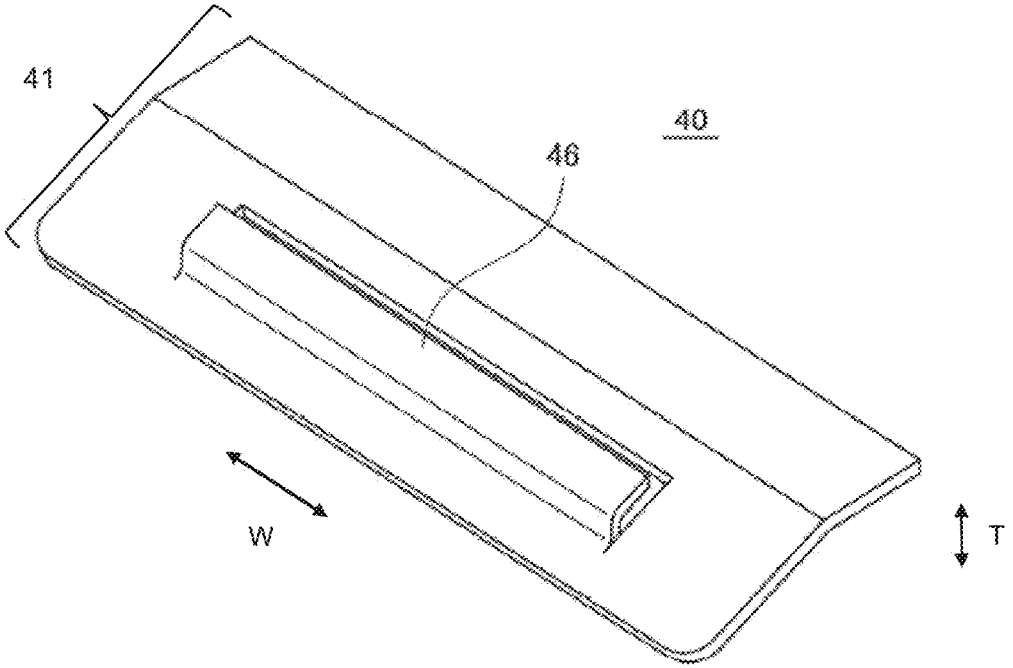
FIG. 8 is a perspective view of a plate of a modified example.

In the example shown in FIG. 8, a hook-shaped claw 46 (claw, claw portion) is provided as a hook. The claw 46 extends from the main portion 41 of the plate 40, in particular, from an intermediate position of the main portion 41 of the plate 40 in the longitudinal direction L of the wire bundle 32, toward the thickness direction T of the plate 40 and then is bent toward the wire bundle 32 side. The claw 46 is essentially line-symmetrical with respect to the center axis (line) C of the wire bundle 32 in the width direction W. In a state in which the string member 45 is hooked onto the claw 46, the extension positions PA, PB of the string member 45 in the width direction W are at essentially line-symmetrical positions with respect to the center axis (line) C in the width direction W of the wire bundle 32. The claw 46 can be formed by cutting out and bending a part of the plate 40, for example, and thus production is easy and the configuration is simple.

Figure 9:
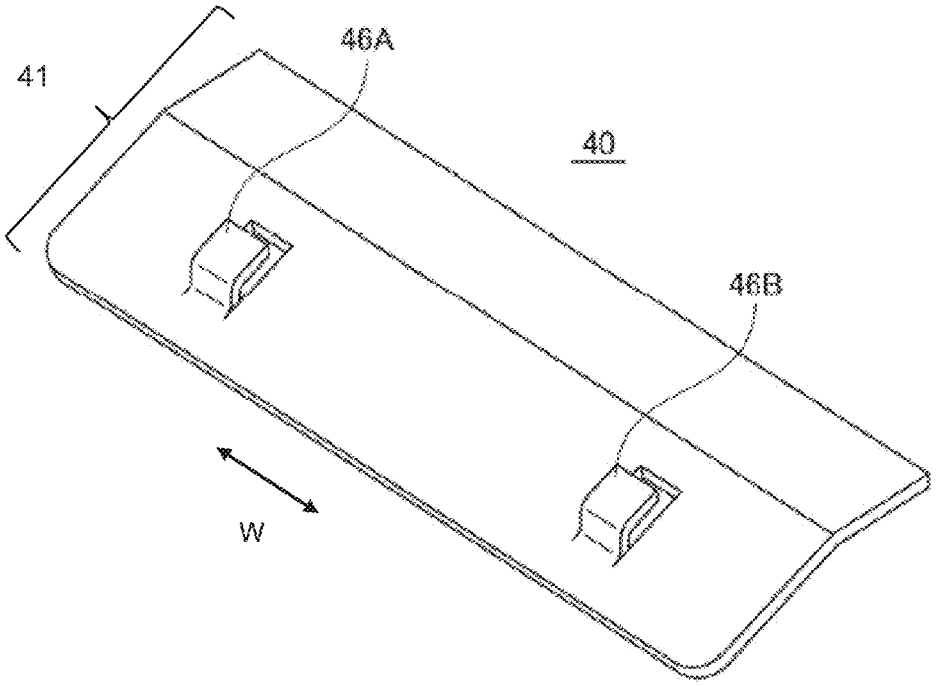
FIG. 9 is a perspective view of a plate of a modified example.

In the configuration shown in FIG. 8, alternatively, a plurality of the claws 46 can be provided, so long as the claws are essentially line-symmetric with respect to the center axis (line) C of the wire bundle 32 in the width direction W. For example, a pair of claws 46A, 46B can be formed, as illustrated in FIG. 9. From this point of view, three or more of claws each of which is the claw 47 shown in FIG. 7 or the claw 46 shown in FIG. 8 or 9 can be provided essentially line-symmetrically with respect to the center axis (line) C in the width direction W of the wire bundle 32.

As another modified example, one or more screws can be screwed into the plate 40 so as to be essentially line-symmetrical with respect to the center axis (line) C of the wire bundle 32 in the width direction W, and one or more head portions of the one or more screws can be made to function as one or more hooks. In that case, the user fixes the one or more screws such that the one or more head portion sides protrude from the plate 40 above the shaft portions of the one or more screws, such that the one or more head portions of the one or more screws are on the distal end side. The method in which a portion having a shape like a head of a screw (for example, the head shape of a nail) is not limited to screwing, and such a portion can be integrally formed with the plate 40.

Figure 10:
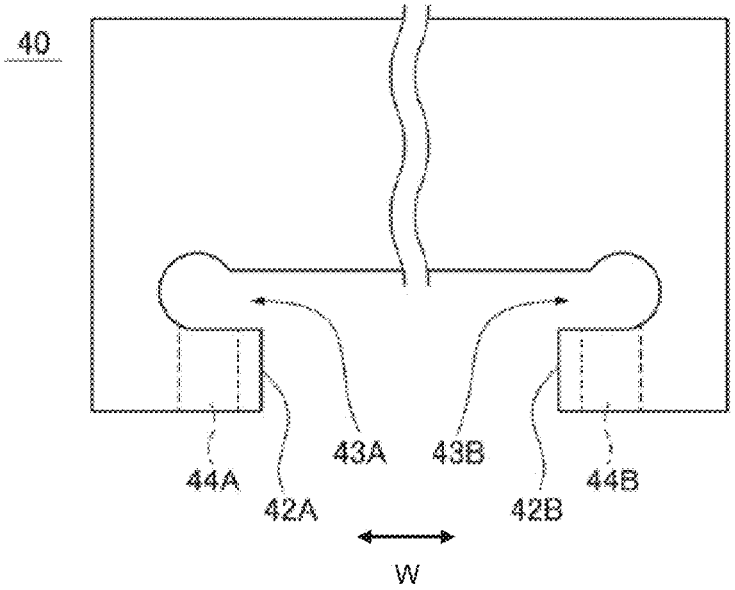
FIG. 10 is a plan view of a plate of a modified example.

FIG. 10 is a plan view of the plate 40 of a modified example. In the examples shown in FIGS. 1 to 5, the cutout portions 43A, 43B open in opposite directions (outside in the width direction W) from each other in the width direction W of the wire bundle 32. In contrast, in the modified example shown in FIG. 10, the cutout portions 43A, 43B are open, facing each other (inner side in the width direction W). Accordingly, the hooks 42A, 42B also extend in the direction facing each other and face each other. It is not essential to provide the concave portions 44A, 44B and the wide portion and narrow portions described above. Even with such a configuration, in a state in which the string member 45 is hooked onto the hooks 42A, 42B, the extension positions PA, PB of the string member 45 can be at essentially line-symmetrical positions with respect to the center axis (line) C of the wire bundle 32 in the width direction W. In particular, when removing the string member 45, it is possible to easily remove the string member 45 by pinching and thus bringing the two extension portions 45A, 45B close together, thus resulting in high workability.

A configuration can be employed in which the configurations of FIGS. 4 and 10 are combined, such that the cutout portions 43A, 43B are open in the same direction in the width direction W of the wire bundle 32, and the hooks 42A, 42B protrude in the same direction.

Figure 11:
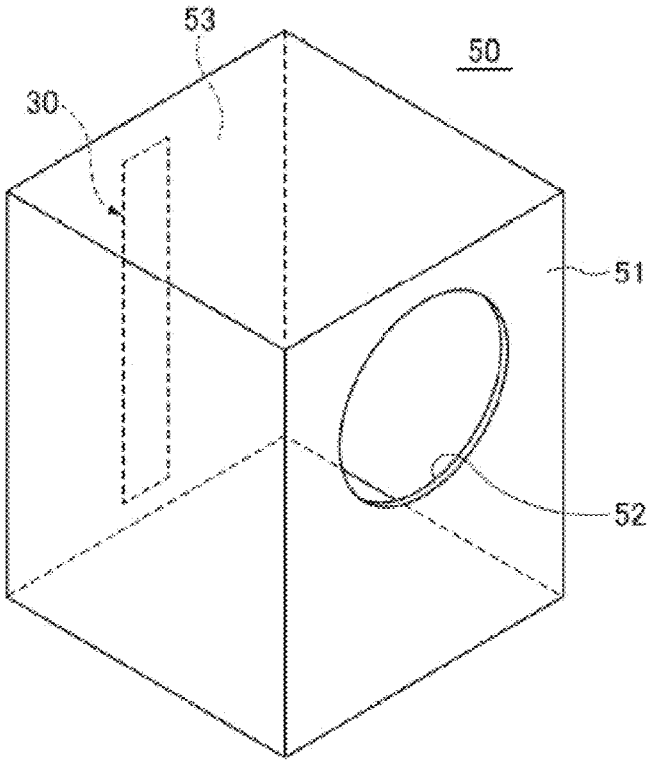
FIG. 11 is a perspective view of a cajon.

The musical instrument to which the effect imparter of this disclosure is employed is not limited to a snare drum 10, but can be applied to a cajon as shown in FIG. 11, for example. FIG. 11 is a perspective view of a cajon. The main body 51 of cajon 50 has an air vent hole 52. The snare wire 30 is provided, for example, on the rear side of a hitting surface 53 of the main body 51. The position at which the snare wire 30 is provided can be any wall portion of the main body 51.

The pair of plates 40 fixed to both ends of the snares 31 (the first end portion 34A and the second end portion 34B) need not have the same configuration. For example, one of the examples shown in FIG. 4 or FIGS. 6 to 10 can be applied to one plate 40, and another of the examples shown in FIG. 4 or FIGS. 6 to 10 can be applied to the other plate 40.

This disclosure was described above based on preferred embodiments, but this disclosure is not limited to the above-described embodiments, and includes various embodiments that do not depart from the scope of the invention. Some of the above-described embodiments can be appropriately combined.

What is claimed is:

1. An effect imparter for a musical instrument comprising:

a wire bundle including at least one snare; and a plate that has a hook configured to be hooked by a string and that is fixed to a first end portion of the wire bundle, wherein the hook is configured such that, in a state in which the string is hooked onto the hook, the string hooked onto the hook has two positions from which two extension portions of the string extend in a longitudinal direction of the wire bundle, from the plate toward an opposite direction of the wire bundle, and the two positions are essentially line-symmetrical with respect to a center axis of the wire bundle in a width direction of the wire bundle.

2. The effect imparter for the musical instrument according to claim 1, wherein the hook includes a pair of cutout portions that are open in opposite directions from each other in the width direction of the wire bundle.

3. The effect imparter for the musical instrument according to claim 2, wherein each of the pair of cutout portions includes a string retainer configured to retain the string in each of the pair of cutout portions.

4. The effect imparter for the musical instrument according to claim 1, wherein the hook includes a string holder configured to partially hold the string and configured to restrict displacement of the string in the width direction of the wire bundle at the two positions.

5. The effect imparter for the musical instrument according to claim 1, wherein the hook is essentially line-symmetrical with respect to a center axis of the wire bundle in a width direction of the wire bundle.

6. The effect imparter for the musical instrument according to claim 5, wherein the hook includes a pair of cutout portions that are open in the width direction of the wire bundle.

7. The effect imparter for the musical instrument according to claim 6, wherein each of the pair of the cutout portions has a first portion with a first width in the longitudinal direction of the wire bundle and a second portion with a second width in the longitudinal direction of the wire bundle, the first portion is disposed in a vicinity of an end position on an opening side of each of the pair of cutout portions, and the first width of the first portion is less than the second width of the second portion.

8. The effect imparter for the musical instrument according to claim 1, wherein the hook has two concaves configured to accommodate two portions of the string in vicinities of the two positions.

9. The effect imparter for the musical instrument according to claim 1, wherein the hook has at least one claw that extends from a main portion of the plate toward a thickness direction of the main portion, and bends toward a side of the wire bundle.

10. The effect imparter for the musical instrument according to claim 1, further comprising an additional plate that has an additional hook configured to be hooked by an additional string and that is fixed to a second end portion of the wire bundle.

* * * * *